US006340015B1

(12) United States Patent
Benedikt et al.

(10) Patent No.: US 6,340,015 B1
(45) Date of Patent: Jan. 22, 2002

(54) FUEL INJECTION VALVE WITH INTEGRATED SPARK PLUG

(75) Inventors: Walter Benedikt, Kornwestheim; Franz Rieger, Schwieberdingen; Rainer Norgauer, Ludwigsburg, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/486,528

(22) PCT Filed: Mar. 24, 1999

(86) PCT No.: PCT/DE99/00861

§ 371 Date: May 25, 2000

§ 102(e) Date: May 25, 2000

(87) PCT Pub. No.: WO00/00737

PCT Pub. Date: Jan. 6, 2000

(30) Foreign Application Priority Data

Jun. 27, 1998 (DE) ..... 198 28 848

(51) Int. Cl.[7] ..... F02M 57/06; F02M 61/16

(52) U.S. Cl. ..... 123/297

(58) Field of Search ..... 123/297, 169 E, 123/169 P, 169 V; 313/120; 239/88

(56) References Cited

U.S. PATENT DOCUMENTS

| | | | | | |
|---|---|---|---|---|---|
| 2,255,203 | A | * | 9/1941 | Weigand | 313/11.3 |
| 2,403,440 | A | * | 7/1946 | Jansson | 313/120 |
| 3,058,453 | A | * | 10/1962 | May | 123/297 |
| 3,060,912 | A | * | 10/1962 | May | 123/297 |
| 3,060,913 | A | * | 10/1962 | May | 123/297 |
| 3,081,758 | A | * | 3/1963 | May | 239/87 |
| 3,373,724 | A | * | 3/1968 | Papst | 123/297 |
| 3,795,214 | A | * | 3/1974 | Shook, II | 123/297 |
| 3,926,169 | A | * | 12/1975 | Leshner et al. | 123/297 |
| 4,736,718 | A | * | 4/1988 | Linder | 123/297 |
| 4,967,708 | A | * | 11/1990 | Linder et al. | 123/297 |
| 5,409,165 | A | | 4/1995 | Carroll, III et al. | 239/88 |
| 5,497,744 | A | * | 3/1996 | Nagaosa et al. | 123/297 |
| 5,531,199 | A | * | 7/1996 | Bryant et al. | 123/297 |
| 5,607,106 | A | | 3/1997 | Bentz et al. | 239/88 |
| 5,715,788 | A | * | 2/1998 | Tarr et al. | 123/297 |
| 5,983,855 | A | * | 11/1999 | Benedikt et al. | 123/297 |

FOREIGN PATENT DOCUMENTS

| | | | | |
|---|---|---|---|---|
| EP | 632198 | * | 1/1995 | F02M/57/06 |
| EP | 0 661 446 | | 7/1995 | |
| JP | 05 240126 | | 9/1993 | |
| JP | 06 050241 | | 2/1994 | |

* cited by examiner

*Primary Examiner*—John Kwon
*Assistant Examiner*—Hieu T. Vo
(74) *Attorney, Agent, or Firm*—Kenyon & Kenyon

(57) ABSTRACT

A fuel injection valve (1) having an integrated sparkplug for direct injection of fuel into the combustion chamber of an internal combustion engine and for igniting the fuel injected into the combustion chamber has a valve body (7) which, together with a valve closing body (10) operated by a valve needle (9), forms a seal seat. The valve body (7) and to some extent the valve needle (9) are surrounded radially by an insulating body (6). The insulating body (6) is in turn surrounded radially at least in part by a housing body (2). Ignition electrodes (15, 16) are provided on the valve body (7) and the housing body (2). The valve needle (9) has a first metal guide section **(9*a*) guided in a swirl insert (14), a second metal guide section (9*b*) guided in the insulating body (6) and an insulating section (9*c*) arranged between the guide sections (9*a*, 9*b*). The guide sections (9*a*, 9*b*) are connected in a positive manner to the insulating section (9*c*)**.

16 Claims, 1 Drawing Sheet

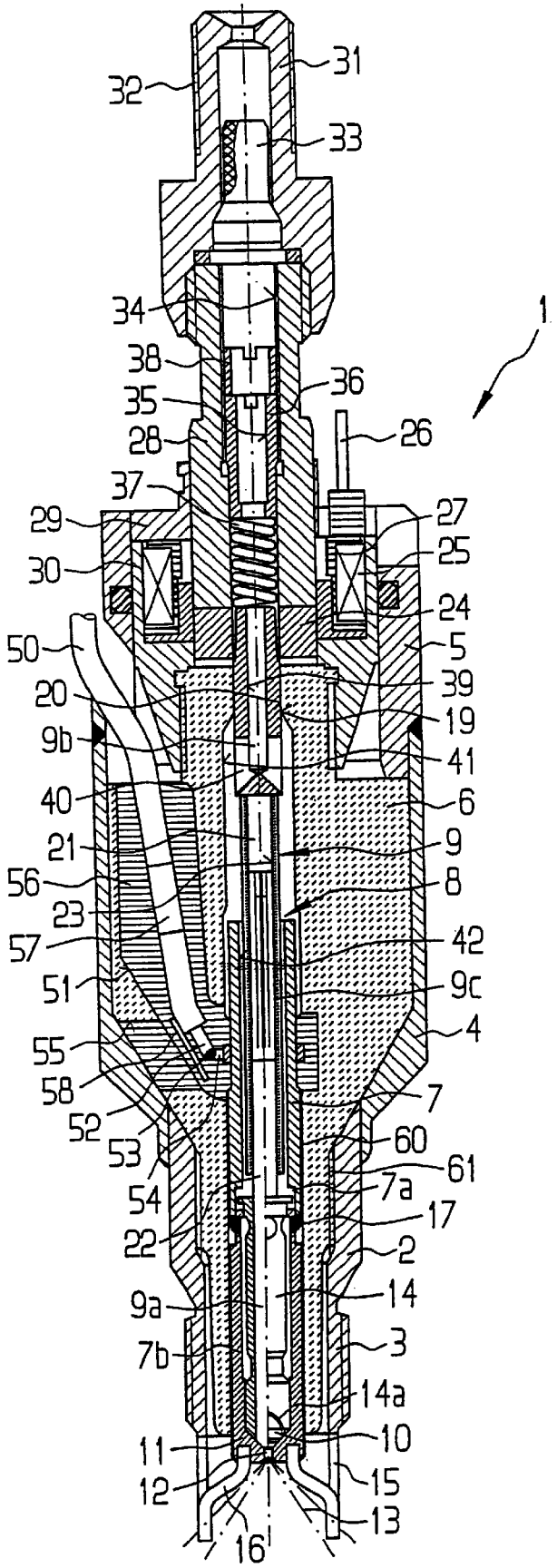
1
2
3
4
5
6
7
7a
7b
8
9
9a
9b
9c
10
11
12
13
14
14a
15
16
17
19
20
21
22
23
24
25
26
27
28
29
30
31
32
33
34
35
36
37
38
39
40
41
42
50
51
52
53
54
55
56
57
58
60
61

FUEL INJECTION VALVE WITH INTEGRATED SPARK PLUG

FIELD OF THE INVENTION

The present invention concerns a fuel injection valve having an integrated sparkplug.

BACKGROUND INFORMATION

A fuel injection valve having an integrated sparkplug for direct injection of fuel into the combustion chamber of an internal combustion engine and for igniting the fuel injected into the combustion chamber is discussed in from German Published Patent Application No. 196 38 025. With this fuel injection valve having an integrated sparkplug, a valve closing body that opens on the outside works together with a valve body to form a seal seat. The valve closing body is designed in one piece with a valve needle extending into the interior of the sleeve-shaped valve body. The valve needle is guided through the valve closing body on one end and through a guide ring provided at the inlet on the other end. The valve body can receive an electrical high voltage over a high-voltage cable and it has an ignition electrode on its spray end. The valve body is surrounded radially by a ceramic insulating body which is in turn surrounded by a metal housing body having another ignition electrode. The valve needle and the valve closing body, which is designed in one piece with the valve needle, are actuated in the opening direction by an armature working together with a solenoid. The armature acts by way of a tappet on an insulating spacer which is in contact with the guide ring of the valve needle.

One disadvantage of this design of a fuel injection valve having an integrated sparkplug is that the valve needle does not have a high-voltage insulating element. Therefore, the insulation is provided by the aforementioned spacer, which is connected to the valve needle only in a non-positive manner but not in a positive manner. Therefore, this design is suitable only for externally opening fuel injection valves. Since only an opening force can be transmitted via the spacer to the valve closing body but no closing force can be transmitted via the valve needle to the valve closing body, a valve closing spring must be integrated into the valve body to produce the closing force. It is believed that this leads to a relatively complicated design and thus to relatively high manufacturing and assembly costs.

Another fuel injection valve having an integrated sparkplug is discussed in European Published Patent Application No. 0 661 446. Again with this fuel injection valve having an integrated sparkplug, no insulating element is provided in the valve needle. Instead, the high voltage is supplied via the valve needle, which is insulated radially on the outside by complicated insulating bodies extending in the feed direction. With this unfavorable design, a total of four insulating bodies are necessary, leading to high manufacturing and assembly costs.

SUMMARY OF THE INVENTION

The fuel injection valve having an integrated sparkplug an exemplary embodiment of the present invention has the advantage that an insulating section which provides insulation in the axial direction is integrated into the valve needle, separating the two metal guide sections from one another. The magnetic needle is guided through the metal guide sections which may be made of hardened steel, for example, and therefore permit precision manufacturing and their surfaces have a low coefficient of friction. A first guide section is arranged on the spray end and may be designed in one piece with the valve closing body. The second metal guide section is arranged on the inlet end with regard to the insulating section arranged between the guide sections and is guided in the insulating body. The guide sections having the insulating section are also connected in a positive manner as well as in a non-positive manner, so that force can be transmitted via the valve needle in the opening direction as well as the closing direction. Therefore, it is not necessary to integrate a restoring spring inside the valve body. This yields a simple design which can be produced at a low manufacturing and assembly cost. The insulating body can be manufactured as an injection molded ceramic part at a low manufacturing cost. Since the insulating section is responsible only for the insulation and not for guidance of the valve needle, it is believed that no particularly high demands are made of the manufacturing accuracy and abrasion resistance of the insulating section.

The fuel injection valve an exemplary embodiment of the present invention having an integrated sparkplug has the advantage that the valve needle designed as a one-piece ceramic part with the valve closing body can be designed to be especially short, because no metal parts are used and the total length of the valve needle functions as an insulating path. Shortening the valve needle yields a definite reduction in weight, which in turn leads to relatively short switching times.

It is advantageous to design the insulating section of the valve needle as a ceramic sleeve body, because an especially low weight, and thus a short switching time, is obtained because of the material saved when the insulating section is designed as a sleeve body. The connection between the guide sections and the insulating section is preferably by way of connecting pins which engage in corresponding recesses. The connection can be accomplished by friction flow, gluing or even in part by shrink fit.

If the valve needle and the valve closing body are designed as a one-piece ceramic part, the valve closing body is preferably spherical or partially spherical in shape to prevent material from splintering out in the seat area.

The insulating body preferably has a recess at the side through which a high-voltage cable is guided to the valve body and is electrically connected to it. It is advantageous to fill the recess with a casting compound which provides electrical insulation, because this yields especially good protection of the welded or soldered junction of the high-voltage cable with the valve body. It may be especially advantageous for an electric burn-off resistor or an insulating film with high-voltage strength to be cast in the casting compound to improve insulation of the solder joint or weld.

One embodiment of the present invention is illustrated in simplified form in the drawing and explained in greater detail in the following description.

BRIEF DESCRIPTION OF THE DRAWING

The FIGURE shows a cross-section of a fuel injection valve having an integrated sparkplug according to an exemplary embodiment of the present invention.

DETAILED DESCRIPTION

The FIGURE shows a fuel injection valve having an integrated sparkplug for direct injection of fuel into a combustion chamber of an internal combustion engine with compression of a mixture and spark ignition and for igniting the fuel injected into the combustion chamber according to an exemplary embodiment of the present invention.

The fuel injection valve having an integrated sparkplug and labeled with reference number 1 in general has a first housing body 2, which can be screwed into a receiving bore of a cylinder head (not shown) by a thread 3, and also has a second housing body 4 and a third housing body 5. The metal housing formed by housing bodies 2, 4, 5 surrounds an insulating body 6 which in turn surrounds radially on the outside a valve body 7 and at least partially a swirl insert 14 and a valve needle 9 extending in the interior of swirl insert 14 beyond inlet end 8 of valve body 7. Valve needle 9 is connected at the spray end to conical valve closing body 10 which together with an inside conical face on spray end 11 of valve body 7 forms a seal seat. In the embodiment illustrated here, valve needle 9 and valve closing body 10 are designed in one piece. When valve closing body 10 is lifted up from the valve seating face of valve body 7, valve closing body 10 releases an outlet opening 12 formed in valve body 7, so that a conical spray jet indicated by line 13 is sprayed out. For a better peripheral distribution of fuel, at least one swirl groove 14*a* is provided in swirl insert 14 in the embodiment illustrated here.

First ignition electrodes 15 are provided on first housing body 2 and work together with second ignition electrodes 16 provided on valve body 7 to generate an ignition spark. In the embodiment shown here, ignition electrodes 15, 16 are designed as partially parallel finger electrodes. A first ignition electrode 15 and a second ignition electrode 16 are arranged opposite one another in alternation at a predetermined electrode spacing. First ignition electrodes 15 carry ground potential, while second electrodes 16 can receive a high voltage. The lengths of ignition electrodes 15 and 16 are to be adapted to the beam angle and form of fuel jet 13. Ignition electrodes 15, 16 may be immersed in fuel jet 13 or fuel jet 13 may pass by ignition electrodes 15, 16 at a slight distance, without ignition electrodes 15, 16 being wetted by the fuel. Immersion of ignition electrodes 15, 16 in gaps between individual jets produced by one or more outlet openings 12 is also conceivable.

Valve body 7 is preferably designed in two parts, a first body part 7*a*and a second body part 7*b* that are welded together at weld 17 to accommodate swirl insert 14.

According to an exemplary embodiment of the present invention, valve needle 9 is divided into a first metal guide section 9*a* on the spray end, a second metal guide section 9*b* on the inlet end and a ceramic insulating section 9*c* which is sleeve-shaped in this embodiment. First guide section 9*a* is guided in swirl insert 14 mounted concentrically to valve body 7. A second guidance of valve needle 9 is accomplished by second guide section 9*b* in insulating body 6. To do so, lateral surface 19 of second guide section 9*b* works together with a bore 20 in insulating body 6. Guide sections 9*a* and 9*b* which provide guidance are designed as metal parts and can be produced with the manufacturing accuracy required for the guidance. Because of the low surface roughness of the metal parts, there is only a low coefficient of friction on the guides. Insulating section 9*c*, however, may be produced as an injection molded ceramic part. Since insulating section 9*c* does not provide guidance for valve needle 9, low demands are made regarding the dimensional accuracy and surface roughness. Therefore, no reworking of the injection molded ceramic part is necessary.

According to an exemplary embodiment of the present invention, guide sections 9*a* and 9*b* are joined to insulating section 9*c* by both positive and non-positive methods. In the embodiment illustrated here, guide sections 9*a* and 9*b* each have a pin 21 and 22, respectively, inserted into a recess in insulating section 9*c* designed as a bore 23. Preferably a connection is established between pins 21 and 22 and guide sections 9*a* and 9*b* by frictional engagement, gluing or to some extent even by shrink fitting. For a shrink-fit connection, it is advantageous if guide section 9*b* has a recess into which a pin of insulating section 9*c* can be inserted, in another exemplary embodiment shown here. Metal guide section 9*b* may then be heated before shrinkage, and the pin of insulating section 9*c* can be inserted into the recess when this guide section has been heated. When guide section 9*b* cools, it contracts, yielding a tight connection to insulating section 9*c*.

Insulating section 9*c* is preferably designed in the form of a sleeve. Weight is saved due to the material saved in comparison with a solid body, thus resulting in shorter switching times of fuel injection valve 1.

According to an another exemplary embodiment not shown here, it is also possible to design valve needle 9 and valve closing body 10 as a one-piece ceramic part. Valve needle 9 may then be designed shorter in comparison with the exemplary embodiment shown in the figure because valve needle 9 has insulating properties over its entire length. This yields weight savings for valve needle 9, leading to shorter switching times. If valve needle 9 and valve closing body 10 are designed as a one-piece ceramic part, it is advantageous if valve closing body 10 is spherical or partially spherical to prevent material from splintering out at the seal seat.

Silicon nitride or zirconium oxide is suitable for achieving an especially low weight for insulating section 9*c* and for valve needle 9 with valve closing body 10, which are designed as a one-piece ceramic part according to the alternative embodiment.

Second guide section 9*b* is connected to an armature 24 which works together with a solenoid 25 for electromagnetic operation of valve closing body 10. A cable 26 is used to supply electric current to solenoid 25. A field spool 27 accommodates solenoid 25. A sleeve-shaped core 28 passes at least partially through solenoid 25 and is a distance away from armature 24 due to a gap (not shown in the Figure) in the closed position of the fuel injection valve. The magnetic flux circuit is closed by ferromagnetic parts 29 and 30. Fuel flows through a fuel inlet connection 31, which can be connected by a thread 32 to a fuel distributor (not shown), and into the fuel injection valve 1 having an integrated sparkplug. Fuel flows first through a fuel filter 33 and then into a longitudinal bore 34 in core 28. An adjusting sleeve 36, which has a hollow bore 35 and can be screwed into longitudinal bore 34 of core 28, is provided in longitudinal bore 34. Adjusting sleeve 36 is used to adjust the initial tension of a restoring spring 37 which acts on armature 24 in the closing direction. A locking sleeve 38 secures the adjustment of adjusting sleeve 36.

Fuel flows further through a longitudinal bore 39 into second guide section 9*b* of valve needle 9 and enters a hollow space 41 of insulating body 6 at an axial recess 40. Fuel flows from there into a longitudinal bore 42 of valve body 7 through which valve needle 9 also extends, and ultimately the fuel reaches swirl groove 14*a* of swirl insert 14 described above.

As described above, first ignition electrodes 15 connected to housing body 2 carry ground potential while second ignition electrodes 16 connected to valve body 7 carry a high voltage to generate ignition sparks. A high-voltage cable 50 which is inserted into insulating body 6 through a pocket-like recess 51 at the side supplies the high voltage. Bare end 52 of high-voltage cable 50 is soldered or welded to a contact clip 54 at a solder junction or weld 53. Contact clip 54 clamps valve body 7 and establishes a secure electrical contact between bare end 52 of high-voltage cable 50 and valve body 7. For better accessibility of solder junction or weld 53, insulating body 6 has a radial bore 55 through which a soldering or welding tool can be guided to the solder junction or weld 53. After establishing the soldered or welded connection, pocket-like recess 51 is filled with a casting compound 56 which provides electrical insulation. A burn-off resistor 57 integrated into high-voltage cable 50 may also be cast in casting compound 56. For improved insulation of solder junction or weld 53, a film 58 having high-voltage strength may be inserted into pocket-like recess 51 of insulating body 6 and also cast with casting compound 56. Silicone, for example, is suitable for use as casting compound 56.

Insulating body 6 and valve body 7 may be screwed together by a thread 60. Furthermore, insulating body 6 may be screwed to housing body 2 with another thread 61. Thread 60 and 61 are preferably secured with a suitable adhesive, although in the exemplary embodiment of the present invention, the adhesive does not come into direct contact with the fuel. Insulating body 6 may be manufactured inexpensively as an injection molded ceramic part. Valve body 7 and insulating body 6 may be screwed and glued to an assembly mandrel to compensate for alignment errors in the guidance of valve needle 9.

The spatially close arrangement of burn-off resistor 57 to ignition electrodes 15, 16 reduces the burn-off of ignition electrodes 15, 16 and allows a solid metal jacketing of fuel injection valve 1 having an integrated sparkplug by metal housing bodies 2, 4 and 5, despite an increased electric capacitance between ignition electrodes 15, 16.

What is claimed is:

1. A fuel injection valve associated with an integrated sparkplug for achieving a direct injection of a fuel into a combustion chamber of an internal combustion engine and for igniting the fuel injected into the combustion chamber, comprising:

a valve body;

a valve needle;

a valve closing body operated by the valve needle and for forming a seal seat with the valve body;

an insulating body radially surrounding the valve body and at least partially surrounding the valve needle, wherein the valve needle includes:

a first metal guide section guided in the valve body, a second metal guide section guided in the insulating body, and an insulating section arranged between the first metal guide section and the second metal guide section, the first metal guide section and the second metal guide section being connected in a positive manner to the insulating section;

a housing body radially surrounding the insulating body at least in part; and at least one ignition electrode provided on at least one of the valve body and the housing body.

2. The fuel injection valve of claim 1, wherein the insulating section of the valve needle is formed by a ceramic sleeve body.

3. The fuel injection valve of claim 2, wherein the connection between the insulating section and the first metal guide section and the second metal guide section is formed by one of a frictional engagement operation, a gluing operation, and a shrink fitting operation.

4. The fuel injection valve of claim 1, wherein the first metal guide section and the second metal guide section each includes a respective connecting pin inserted into a recess in the insulating section.

5. The fuel injection valve of claim 1, wherein:

the insulating section includes a connecting pin, and the connecting pin is inserted into a recess of the second metal guide section.

6. The fuel injection valve of claim 1, wherein:

the insulating body includes a recess at a side through which a high-voltage cable is guided to the valve body and is electrically connected thereto, and the recess is filled with a casting compound that provides an electrical insulation.

7. The fuel injection valve of claim 6, further comprising:

an electric burn-off resistor cast in the casting compound and integrated with the high-voltage cable.

8. The fuel injection valve of claim 6, wherein:

the high-voltage cable is connected, by one of a solder connection and a weld connection, to one of the valve body and a contact clip clamping the valve body, and the one of the solder connection and the weld connection is covered by an insulating film having a high-voltage strength and being integrally cast in the casting compound.

9. The fuel injection valve of claim 1, wherein the valve body includes two valve body parts that are joined together by a weld.

10. A fuel injection valve associated with an integrated sparkplug for achieving a direct injection of a fuel into a combustion chamber of an internal combustion engine and for igniting the fuel injected into the combustion chamber, comprising:

a valve body;

a valve needle;

a valve closing body operated by the valve needle and for forming a seal seat with the valve body, wherein the valve needle and the valve closing body are formed from a one-piece ceramic part;

an insulating body radially surrounding the valve body and at least partially surrounding the valve needle;

a housing body radially surrounding the insulating body at least in part; and at least one ignition electrode provided on at least one of the valve body and the housing body.

11. The fuel injection valve of claim 10, further comprising:

a first guide section arranged inside the valve body; and a second guide section arranged inside the insulating body, wherein the one-piece ceramic part is guided on the first guide section and on the second guide section.

12. The fuel injection valve of claim 10, wherein a shape of the valve closing body is one of spherical and partially spherical.

13. The fuel injection valve of claim 10, wherein:

the insulating body includes a recess at a side through which a high-voltage cable is guided to the valve body and is electrically connected thereto, and the recess is filled with a casting compound that provides an electrical insulation.

14. The fuel injection valve of claim 13, further comprising:

an electric burn-off resistor cast in the casting compound and integrated with the high-voltage cable.

15. The fuel injection valve of claim 13, wherein:

the high-voltage cable is connected, by one of a solder connection and a weld connection, to one of the valve body and a contact clip clamping the valve body, and the one of the solder connection and the weld connection is covered by an insulating film having a high-voltage strength and being integrally cast in the casting compound.

16. The fuel injection valve of claim 10, wherein the valve body includes two valve body parts that are joined together by a weld.

* * * * *

UNITED STATES PATENT AND TRADEMARK OFFICE

CERTIFICATE OF CORRECTION

PATENT NO. : 6,340,015 B1
DATED : January 22, 2002
INVENTOR(S) : Benedikt et al.

It is certified that error appears in the above-identified patent and that said Letters Patent is hereby corrected as shown below:

Title page,
Item [57], ABSTRACT, change the ABSTRACT to read -- A fuel injection valve having an integrated sparkplug for direct injection of fuel into the combusion chamber of an internal combustion engine and for igniting the fuel injected into the combustion chamber has a valve body that, together with a valve closing body operated by a valve needle, forms a seal seat. The valve body and to some extent the valve needle are surrounded radially by an insulating body. The insulating body is surrounded radially at least in part by a housing body. Ignition electrodes are provided on the valve body and the housing body. The valve needle has a first metal guide section guided in a swirl insert, a second metal guide section guided in the insulating body and an insulating section arranged between the guide sections. The guide sections are connected in a positive manner to the insulating section. --.

Column 1,
Line 13, delete “from”
Line 60, change “sparkplug an” to -- sparkplug according to an --

Column 2,
Line 20, change “valve an” to -- valve according to an --

Column 3,
Line 42, change “parts, a” to -- parts, including a --
Line 43, change “7aand” to -- 7a and --

Column 4,
Line 6, change “shrink-fit” to -- shrink-fitting --
Line 24, change “figure” to -- Figure --

Signed and Sealed this

Eighth Day of July, 2003

JAMES E. ROGAN
*Director of the United States Patent and Trademark Office*